US010352650B2

(12) United States Patent
Hiler, Jr. et al.

(10) Patent No.: US 10,352,650 B2
(45) Date of Patent: Jul. 16, 2019

(54) FIREARM HANDGUARD SECUREMENT SYSTEM AND RELATED METHOD

(71) Applicant: Spec Arms LLC, Sparta, MI (US)

(72) Inventors: Lee B. Hiler, Jr., Comstock Park, MI (US); Tadd Richard Woodard, Howard City, MI (US); David McClaran Riser, II, Ada, MI (US)

(73) Assignee: Spec Arms LLC, Sparta, MI (US)

( * ) Notice: Subject to any disclaimer, the term of this patent is extended or adjusted under 35 U.S.C. 154(b) by 30 days.

(21) Appl. No.: 15/895,289

(22) Filed: Feb. 13, 2018

(65) Prior Publication Data

US 2019/0170476 A1 Jun. 6, 2019

Related U.S. Application Data

(63) Continuation-in-part of application No. 29/628,065, filed on Dec. 1, 2017, now Pat. No. Des. 847,934.

(51) Int. Cl.

| | |
|---|---|
| ***F41C 23/16*** | (2006.01) |
| ***F41A 21/48*** | (2006.01) |
| ***F41A 3/66*** | (2006.01) |

(52) U.S. Cl.

CPC ..... *F41C 23/16* (2013.01); *F41A 3/66* (2013.01); *F41A 21/48* (2013.01)

(58) Field of Classification Search

CPC ..... F41C 23/16; F41A 21/44; F41A 21/48; F41A 21/481; F41A 21/482; F41A 3/66

USPC ..... 42/90, 71.01, 72, 75.02

See application file for complete search history.

(56) References Cited

U.S. PATENT DOCUMENTS

| | | | |
|---|---|---|---|
| 5,519,954 | A | 5/1996 | Garrett |
| D603,011 | S | 10/2009 | Fitzpatrick et al. |
| D636,832 | S | 4/2011 | Mayberry et al. |
| D689,974 | S | 9/2013 | Sharps |
| D710,476 | S | 8/2014 | Rogers |

(Continued)

OTHER PUBLICATIONS

AT3 Tactical article the 7 Things to Look for in an AR-15 Handguard downloaded from https://www.at3tactical.com/blogs/news/9243847-the-7-things-to-look-for-in-an-ar-15-handguard on Jun. 13, 2017.

(Continued)

*Primary Examiner* — Jonathan C Weber

(74) *Attorney, Agent, or Firm* — Warner Norcross + Judd LLP

(57) ABSTRACT

A handguard securement system and related method are provided. The system can include a barrel nut that secures a barrel to a receiver and forces a handguard against the receiver. The barrel nut can include one or more annular grooves. When the handguard is initially installed loosely adjacent the receiver, over the barrel nut, the grooves are misaligned with corresponding handguard fastener holes, such that portions of the barrel nut obstruct a portion of the holes. When the fasteners are advanced in the holes, and into further registration with the corresponding grooves, this results in a rearward force exerted by the fasteners on the perimeters of the holes to thereby drive with that force the handguard into forced engagement with the receiver. Any gap between the handguard and the receiver can subsequently be eliminated, with the handguard forcibly pushed against the receiver with the force generated by the fasteners.

20 Claims, 8 Drawing Sheets

(56) References Cited

U.S. PATENT DOCUMENTS

| | | | | |
|---|---|---|---|---|
| 8,819,980 | B2 * | 9/2014 | Geissele | F41C 23/16 42/71.01 |
| 8,904,691 | B1 * | 12/2014 | Kincel | F41C 23/16 42/71.01 |
| D723,130 | S | 2/2015 | Barrett | |
| 8,984,794 | B1 | 3/2015 | Saur | |
| D726,862 | S | 4/2015 | Crume, Sr. | |
| D726,863 | S | 4/2015 | Crume, Sr. | |
| D727,454 | S | 4/2015 | Robinson et al. | |
| D734,828 | S | 7/2015 | Geissele | |
| 9,151,555 | B1 | 10/2015 | Huang | |
| 9,194,638 | B2 | 11/2015 | Larson, Jr. et al. | |
| 9,217,618 | B1 | 12/2015 | Miller, III | |
| D746,936 | S | 1/2016 | Huang | |
| 9,303,949 | B1 | 4/2016 | Oglesby | |
| D755,338 | S | 5/2016 | Slank | |
| 9,389,031 | B2 | 7/2016 | Gardner | |
| 9,389,043 | B1 | 7/2016 | Zhang | |
| D765,211 | S | 8/2016 | Huang | |
| 9,464,865 | B2 * | 10/2016 | Shea | F41C 23/16 |
| D773,585 | S | 12/2016 | Miller, III | |
| D773,587 | S | 12/2016 | Underwood | |
| 9,528,793 | B1 * | 12/2016 | Oglesby | F41C 23/16 |
| D782,596 | S | 3/2017 | Angstadt et al. | |
| 9,599,430 | B1 * | 3/2017 | Geissele | F41C 23/16 |
| D789,480 | S | 6/2017 | Olsen | |
| D795,379 | S | 8/2017 | Frederickson et al. | |
| D795,983 | S | 8/2017 | Cross | |
| 9,829,272 | B2 | 11/2017 | Brown | |
| D805,154 | S | 12/2017 | Steele et al. | |
| 2002/0089767 | A1 | 7/2002 | Bell | |
| 2005/0183317 | A1 | 8/2005 | Finn | |
| 2010/0281736 | A1 | 11/2010 | Mayberry et al. | |
| 2013/0180151 | A1 | 7/2013 | Moore | |
| 2014/0026459 | A1 | 1/2014 | Yan et al. | |
| 2014/0033590 | A1 | 2/2014 | Gomez | |
| 2014/0130390 | A1 * | 5/2014 | Geissele | F41C 23/16 42/71.01 |
| 2014/0165439 | A1 | 6/2014 | Fernandez et al. | |
| 2014/0224235 | A1 | 8/2014 | Liao | |
| 2014/0331535 | A1 | 11/2014 | Robinson et al. | |
| 2014/0373419 | A1 | 12/2014 | Leclair | |
| 2015/0153125 | A1 | 6/2015 | Lutton et al. | |
| 2015/0354912 | A1 | 12/2015 | Miller, III | |
| 2016/0084601 | A1 | 3/2016 | Alicea, Jr. | |
| 2016/0091276 | A1 | 3/2016 | Miller et al. | |
| 2016/0178316 | A1 | 6/2016 | Miller et al. | |
| 2016/0273857 | A1 | 9/2016 | Pettit et al. | |
| 2017/0059273 | A1 * | 3/2017 | Geissele | F41C 23/16 |
| 2017/0160032 | A1 | 6/2017 | Overstreet et al. | |
| 2017/0199006 | A1 | 7/2017 | Hwang et al. | |
| 2017/0254610 | A1 | 9/2017 | Hill | |
| 2017/0299326 | A1 | 10/2017 | Seekins | |
| 2018/0202757 | A1 | 7/2018 | Samson et al. | |
| 2018/0306551 | A1 * | 10/2018 | Reid | F41C 23/16 |

OTHER PUBLICATIONS

AR-Stoner Replacement Barrel Nut Kit for AR-Stoner AR-15 Handguard downloaded from https://www.midwayusa.com/product/1017945720/ar-stoner-replacement-barrel-nut-kit-for-ar-stoner-ar-15-handguard on Oct. 30, 2017.

https://www.thefirearmblog.com/blog/2017/08/30/samsons-new-sxs-lightweight-m-lok-handguards/—Published Aug. 30, 2017.

AR-15 Alpha-Hunter, SpecArmsllc.com, [online], [site visited Mar. 16, 2018]. <URL: https://www.specarmsllc.com/product-page/ar-15-alpha-hunter-specials> (Year: 2018).

AR-15 Alpha-Defender, SpecArmsllc.com, [online], [site visited Mar. 16, 2018]. <URL: https://www.specarmsllc.com/product-page/ar-15-alpha-defender-specials> (Year: 2018).

Battle Arms Development AR-15 BAD556-LW Receiver Set, RainierArms.com, [online], [site visited Mar. 16, 2018]. <URL: https:// www.rainierarms.com/battle-arms-development-bad556-lw-receiver-set/> (Year 2018).

* cited by examiner

FIREARM HANDGUARD SECUREMENT SYSTEM AND RELATED METHOD

BACKGROUND OF THE INVENTION

The present invention relates to firearms, and more particularly to a system and related method to secure a handguard to a firearm.

Many modern sporting and military firearms include a handguard that extends forward and around a barrel of the firearm. The handguard prevents contact between the user and the barrel, thereby protecting the user when the barrel heats up after extended periods of fire. The handguard also can provide one or more rails or other surfaces upon which to mount accessories, such as lights, lasers, grenade launchers and other items.

An issue with many handguards is that they can be difficult to securely and precisely mount to a firearm. Frequently, handguards are provided with screws that tighten against a part of the barrel or some other portion of the firearm. While the screws can hold the handguard in most situations, they can sometimes give way and slide, so that the handguard can rotate, under excessive forces or moments exerted on the handguard, relative to the remainder of the firearm. In turn, this can provide an inadequate grasping surface. In other cases, where the rotation is significant, rails on the handguard can misalign with other rails on the remainder of the firearm. This can be particularly problematic where a sight or laser is mounted on the handguard. As a result of the rotation or misalignment, the firearm can become less accurate or the accessory can be damaged.

Accordingly, there remains room for improvement in the field of handguards, and in particular, the way that they are secured to a firearm to prevent rotation or movement of the handguard, and any associated accessories, relative to the remainder of the firearm.

SUMMARY OF THE INVENTION

A handguard securement system and related method are provided. The system can include a barrel nut that secures a barrel to a receiver and presses a handguard against the receiver under significant force upon installation of a fastener relative to the barrel nut and the handguard.

In one embodiment, the barrel nut includes one or more annular grooves. When the handguard is initially installed loosely adjacent the receiver, over the barrel nut, the groove is slightly misaligned with a corresponding handguard fastener hole. In this configuration, certain portions of the barrel nut obstruct a portion of the hole. In some cases, the amount of obstruction can be precisely provided by selectively setting the length of the handguard between a rear edge of the handguard and the hole.

In another embodiment, the handguard can be positioned relative to the barrel nut and receiver such that when the fastener is advanced in the hole, and into further registration with the corresponding groove, a rearward force is exerted by the fastener on the perimeter of the hole to thereby drive with that rearward force the handguard into forced engagement with the receiver.

In still another embodiment, the system can be configured so that any gap between the handguard and the receiver can be subsequently eliminated, with the handguard forcibly pushed against the receiver under the force generated by the fastener.

In even another embodiment, the system can utilize a fastener including a head, a shank and a tip. The shank and tip can both be cylindrical, but the tip can have a diameter less than the diameter of the shank so that the tip can fit past the obstruction in the fastener hole upon initial installation of the fastener relative to the barrel nut. Optionally, the fastener can be a shoulder bolt or a bolt with a tapered or pointed tip. The shank, configured to engage the barrel nut after initial installation relative to the barrel nut, can be unthreaded so that the shank can slide and rotate easily relative to the barrel nut.

In yet another embodiment, the barrel nut can include a rear surface, and an exterior surface extending forward from the rear surface. The exterior surface can define at least one annular groove such that the exterior surface transitions to a downward extending recess at a forward rim and at a rear rim of the annular groove. The downward extending recess can be bounded by a wall, optionally having a U, V or other concave shape in cross section. The annular groove can include a central axis, also referred to as a groove axis, between the forward rim and the rear rim.

In a further embodiment, the handguard can be disposed over the barrel nut. The handguard can include a rear edge. A slot defined by the handguard can extend forward from the rear edge generally separating a rear end of the handguard into a first part and a second part disposed across from one another. The rear end can define the fastener hole which can be transverse to the slot and that hole can be defined through the first part and the second part. The fastener hole can include a hole axis.

In a further embodiment, the forward rim can be disposed a rim distance from the rear surface of the barrel nut. The fastener hole can include a forwardmost portion. The forwardmost portion of the fastener hole can be disposed a hole distance from the rear edge of the handguard. The hole distance can be slightly greater than the rim distance.

In still a further embodiment, the fastener can be installed in the fastener hole such that the shank can engage the annular groove so as to push the hand guard toward a front surface of the receiver so that the rear edge forcibly engages the front surface of the receiver under a first force of optionally at least 5 pounds, further optionally at least 10 pounds, yet further optionally at least 15 pounds, still further optionally at least 20 pounds or more.

In still yet a further embodiment, the handguard includes an anti-rotation flange extending rearward beyond the rear edge. The anti-rotation flange can be configured for placement immediately adjacent the side surface of the receiver to as to assist in placement and securement of the handguard relative to the receiver.

In a further embodiment, a method of installing the handguard securement system is provided. The method can include: moving a barrel nut over a barrel toward a receiver including a front surface, the barrel nut including a rear surface and a downward extending recess at a forward rim and at a rear rim of the annular groove, which also includes a first central axis between the forward rim and the rear rim; joining the barrel nut with the receiver to secure the barrel to the receiver; positioning a handguard over the barrel nut, the handguard including a rear edge and defining a slot extending forward from the rear edge between a first part and a second part, the handguard defining the fastener hole disposed transverse to the slot through the first part and the second part, the fastener hole including a first hole axis; positioning the rear edge of the handguard adjacent the front surface of the receiver, with the annular groove being misaligned with the fastener hole, with the forward rim obstructing at least a portion of the fastener hole, and with the central axis being offset from the hole axis; inserting a fastener in the fastener hole, the fastener including a shank and a tip; moving the tip past the forward rim toward the slot; and engaging the shank against the forward rim such that the rear edge forcibly engages the front surface of the receiver. With this action, the handguard can be forcibly pressed against the receiver for securement in a fixed position relative to the receiver.

In still a further embodiment, the method can include tightening the fastener such that the first part moves toward the second part of the handguard so that the handguard clamps the barrel nut within the handguard upon the tightening of the fastener.

In yet a further embodiment, the clamping continues as the fastener is advanced in the fastener hole. The clamping can continue as the fastener engages the rim to drive the handguard rearward toward the receiver. The slight difference of the rim distance and the hole distance also can contribute to the amount of force eventually produced to press the rear edge of the handguard into the receiver.

In still yet a further embodiment, the method can include moving a tip of the fastener in the fastener hole such that the tip clears the forward rim of the annular groove but the shank engages the forward rim, when advancing the fastener into the hole, until a thread of the tip engages a corresponding thread of the fastener hole located beyond the slot defined between the first part and second part.

The current embodiments of the handguard securement system and related method of the provide benefits in forming that previously have been unachievable. For example, by offsetting the annular groove of the barrel nut relative to the fastener hole of the handguard, then installing the fastener, the force of that fastener against the handguard produces a significant force to press the rear edge of the handguard into the front surface of the receiver. In turn, this provides an exceptional locking of the handguard in place, which adds significant rigidity to the firearm via the interaction of the handguard and the receiver. As a result, the handguard is firmly and securely mounted to the receiver to maintain a sturdy and consistent orientation and alignment of these elements relative to one another.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
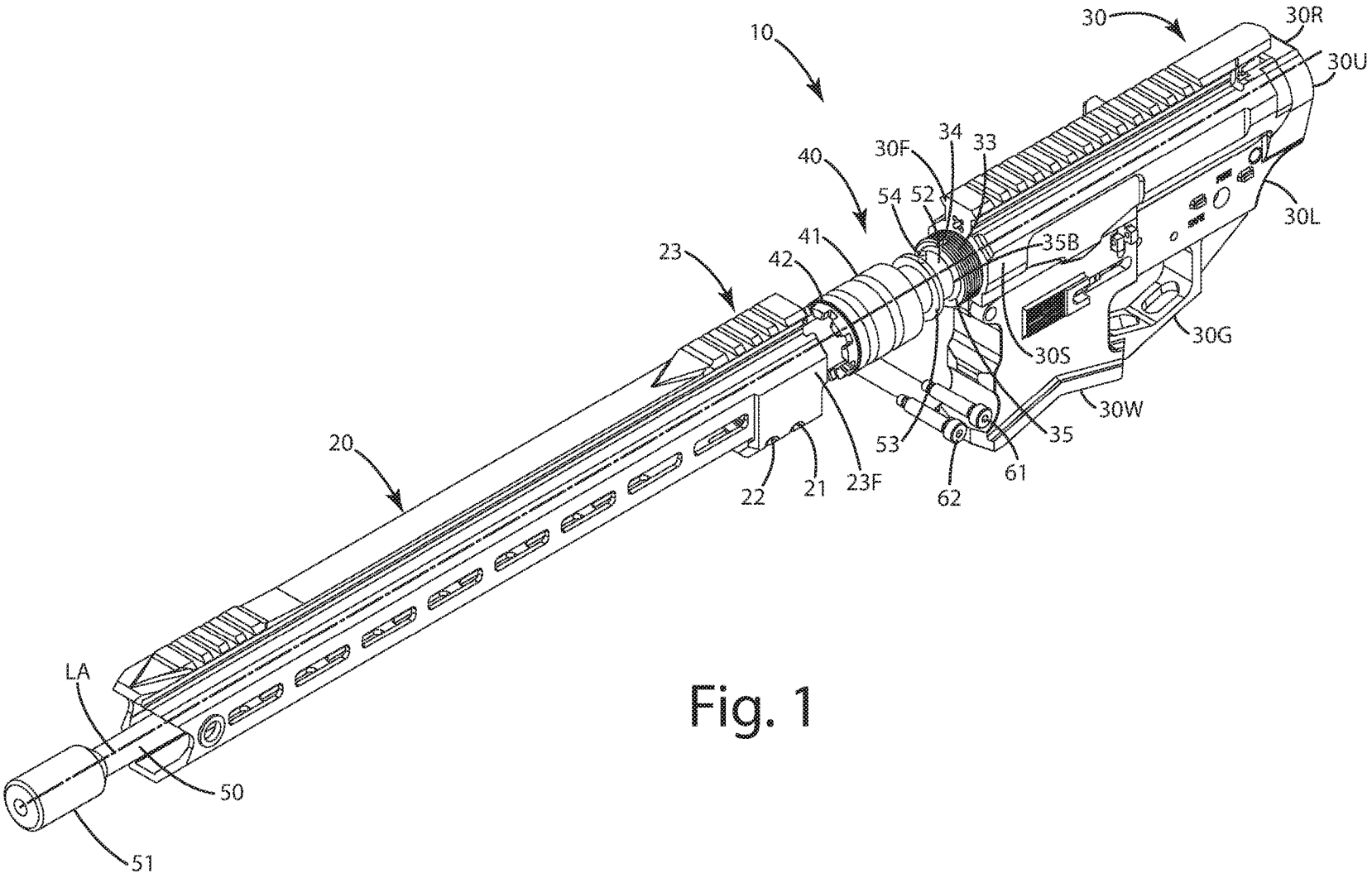
FIG. 1 is a perspective view of the handguard securement system of a current embodiment, shown in an exploded view with a firearm barrel and a receiver.

A current embodiment of the handguard securement system is illustrated in FIGS. 1-8 and generally designated 10. The handguard securement system 10 is generally configured to secure a handguard 20 to a receiver 30 associated with a firearm. The firearm can be a conventional modern sporting, military or hunting rifle, for example an AR15, an AK47, variants thereof and other firearm systems that include a barrel and a handguard. The handguard securement system 10 can include a barrel nut 40 that is threaded onto a base 32 of the receiver 30 to secure a barrel 50 to the receiver 30. The barrel nut 40 can be configured so that when the handguard 20 is initially installed relative to the receiver, over the barrel nut 40, grooves 41 and 42 defined by the barrel nut are misaligned with corresponding handguard fastener holes 21 and 22. As a result, in some cases a gap G1 (greatly exaggerated in the figures) can be established between the handguard 20 and the receiver 30. This gap can be minuscule, and in some cases be such that the surfaces of the handguard and the receiver actually touch or engage one another. With the special configuration of the barrel nut and placement of the grooves, however, when the fasteners 61 and 62 are installed relative to and advanced in corresponding holes 21, 22, further into registration with the corresponding grooves 41, 42, this results in a rearward force exerted by the fasteners on the handguard holes and the material surrounding the holes to thereby drive with that force the handguard 20 into forced engagement with the receiver 30. As a further result, the gap G1, if any, is reduced in dimension or eliminated to a gap G2, which can be zero, shown in FIG. 7. Accordingly, the handguard is forcibly pushed against the receiver with the force generated by the fasteners. In turn, this provides for a securement of the handguard to the receiver that was previously unachievable.

Turning now to FIGS. 1-6, the handguard securement system and components of the firearm will now be described in further detail. To begin, the receiver 30 can be a portion of a firearm. The receiver optionally can include upper and lower receiver parts 30U and 30L. The receiver can include a magazine well 30W and a trigger guard 30G. The receiver 30 can include a rear surface 30R and a front surface 30F. The rear surface 30R can be configured to engage a portion of the lower receiver part. The front surface 30F can extend forward of the magazine well 30W. The front surface can be substantially planar, but in some circumstances can be contoured to reflect or mimic a similar contour on the rear edge of the handguard. The front surface 30F can include a base 32 that extends forwardly from the front surface 30F. The base 32 can be substantially cylindrical as illustrated, but optionally can be other geometric shapes. The base 32 can include a threaded outer surface 33 configured for mating with internal threads 40T of the barrel nut 40 as described below. The cylindrical base 32 also can define a pin recess 34. This pin recess 34 can extend rearwardly from a front edge 35 of the base 32 a preselected distance, but generally does not extend all the way rearward to the front surface 30F of the receiver 30.

As illustrated, the system 10 can cooperate with a barrel 50 of the firearm. The barrel 50 can include a muzzle 51 and a receiver end 52. The receiver end 52 can be configured to be inserted on and/or into the bore 35B defined by the base 32. The barrel can include a barrel extension 53 that is adjacent the receiver end 52. This barrel extension 53 can be a ringlike element that extends around a portion of the receiver end 52 of the barrel, but is spaced distal from that and by a preselected distance D1. This distance can be selected so that the receiver end 52 is placed consistently and precisely within the base 32 and the remainder of the receiver 30, so that it can interact properly with components therein and ammunition fired from the barrel 50. The barrel 50 also can include a barrel indexing pin 54. This barrel indexing pin 54 is configured to be received in the pin recess 34 when the barrel is fully installed relative to the receiver. This indexing pin, when registered in the pin recess, properly indexes the barrel relative to the receiver.

Figure 5:
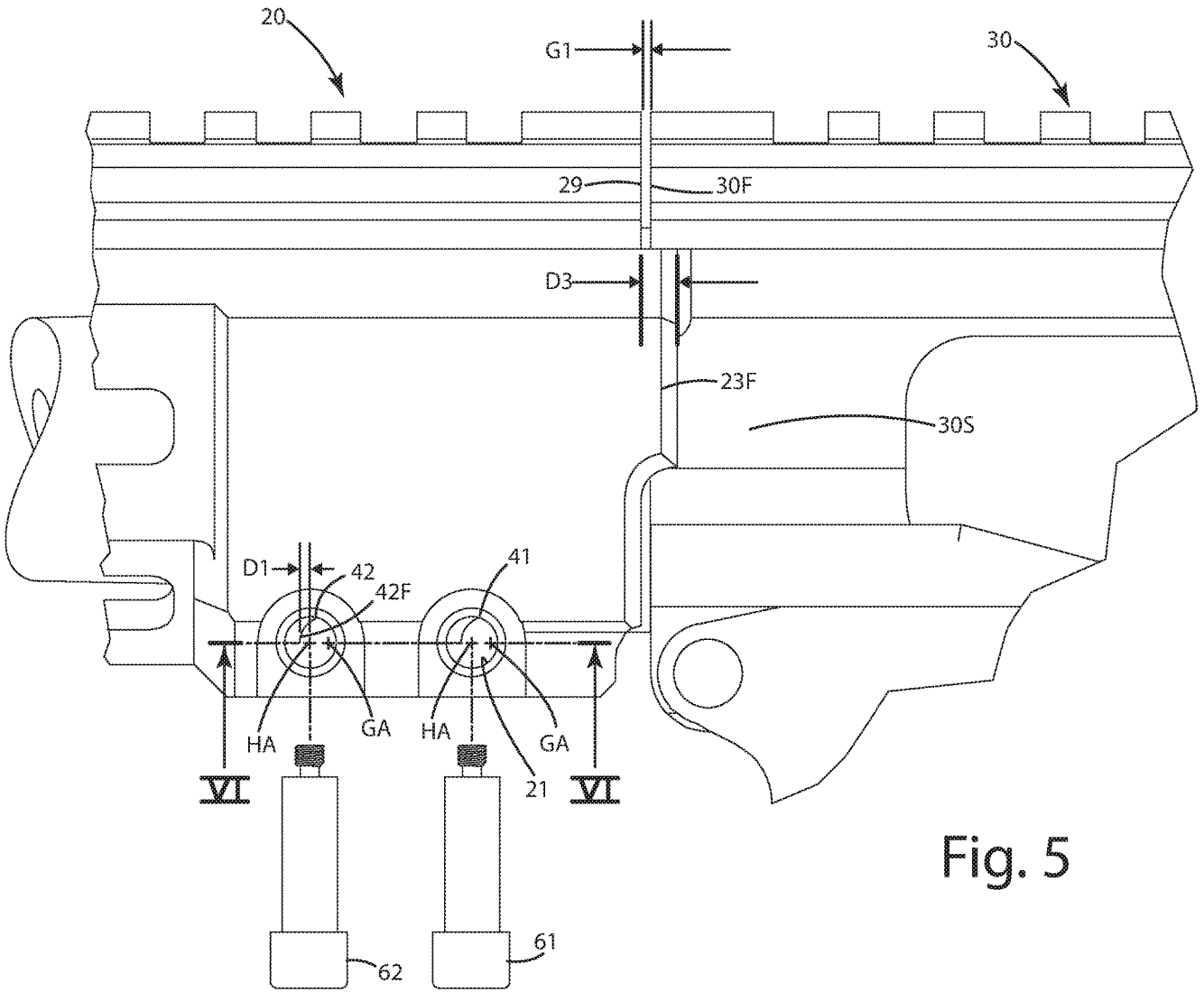
FIG. 5 is a side view of the handguard securement system with the handguard installed over a portion of the barrel nut and the barrel, and fasteners about to be installed for further securement.

The handguard securement system, as shown in FIGS. 1-6 also can include a handguard 20 that can be an elongated tube like member. The handguard can be placed over the barrel 50 and generally over the barrel nut 40. The handguard 20 can include a rear edge 21 and a front edge 22 that is distal from the rear edge 21. The rear edge 21 can form an engagement surface that is configured to mate against the front surface 30F of the receiver 30. The portion of the handguard near the rear edge 21 generally can be referred to as the rear end 23 of the handguard. The rear end also can include anti-rotation flanges 23F. These anti-rotation flanges 23F can be located on the left and right sides or some other portion of the handguard. These anti-rotation flanges 23F can extend rearward, a preselected distance D3 beyond the rear edge 29 of the handguard 20. When the handguard is fully installed, these anti-rotation flanges 23F can be placed immediately adjacent the receiver sidewalls 30S as shown in FIGS. 5 and 7. Optionally these flanges 23F can engage the sidewalls 30S of the receiver 30. Thus, when a rotational force is exerted about a longitudinal axis LA of the barrel, the barrel nut and/or the base, that force will not result in the flanges 23F engage the side surfaces 30S to prevent those the handguard 20 from rotating relative to the receiver 30. This provides extra securement and anti-rotation holding strength, in addition to the forces exerted by the fasteners 61 and 62 to secure the handguard 20 against the receiver 30 as described further below.

Figure 2:
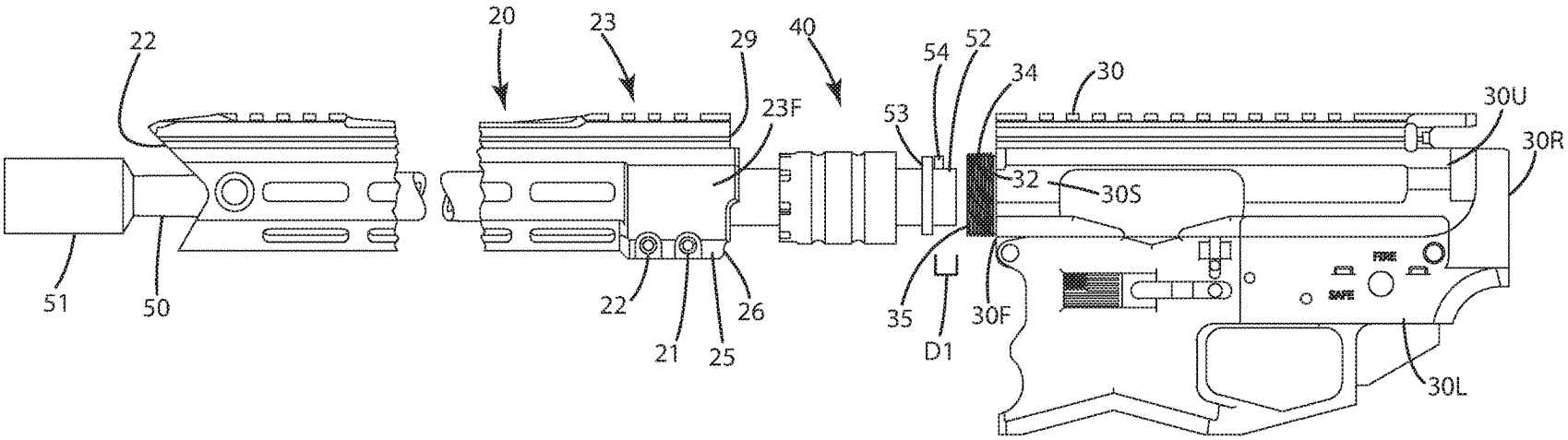
FIG. 2 is a left side exploded view of the handguard securement system.
Figure 6:
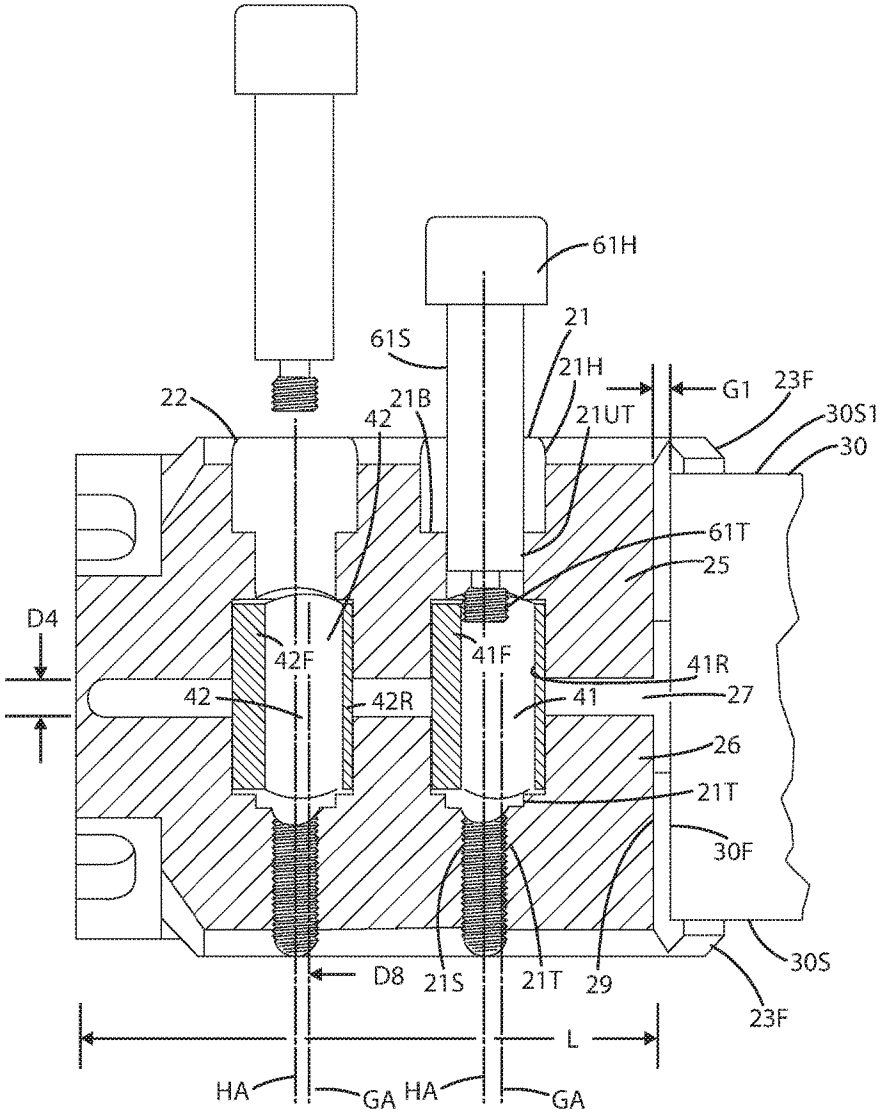
FIG. 6 is a cross section view of the handguard securement system taken along lines 6-6, illustrating a slight misalignment of grooves of the barrel nut with fastener holes defined by the handguard.
Figure 7:
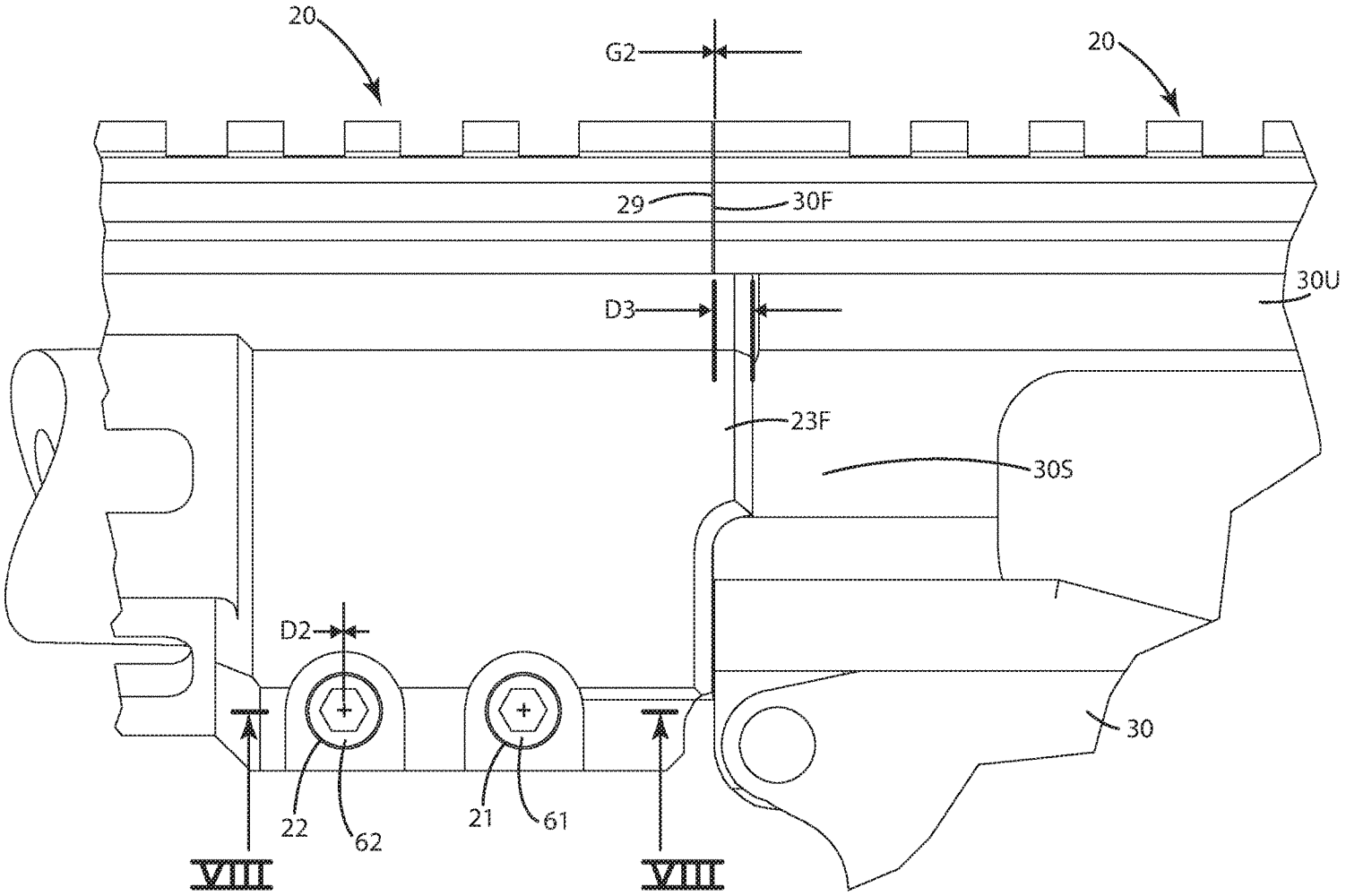
FIG. 7 is a side view of the handguard securement system with the handguard installed over a portion of the barrel nut in the barrel, and fasteners installed to further secure the handguard against a receiver under force.

The handguard 20 rear end 23 can include near the rear edge 29 a first part 25 and a second part 26, as shown in FIGS. 2 and 6. The first part and the second part can be separated by a slit 27 defined between those parts, by the rear end 23. The slit can separate the parts by preselected distance D4. Optionally this distance D4 can be optionally 0.250 inch, further optionally 0.125 inches, yet further optionally 0.050 inches or other dimensions depending on the application. The slit 27 can extend forwardly from the rear edge 21 length L. This length L can be such that the slit 27 extends forward, past the first and second fastener holes 21 and 22. In this manner, the slit can provide some play in the rear portion of the handguard such that the first part and second part can be clampingly brought toward one another to clamp about the barrel nut as described below. The slit 27 also can be transverse relative to the first and second fastener holes 21 and 22. The first and second fastener holes can be configured so that they intersect the slit 23.

The handguard 20 shown in FIGS. 5-7 can define fastener holes 21 and 22. The fastener holes 21 and 22 can include similar features so only one of the holes 21 will be described here. Also, it will be appreciated that although shown with two fastener holes, multiple additional holes can be included, depending on the location of the securement. Further, in some cases, only one fastener hole can be included in the handguard, and likewise only a single groove and fastener might be used in connection with the same. Returning to the fastener hole 21, it can include a head portion or head recess 21H that is configured to receive a head 61H of the fastener. The head recess can define a shoulder at the bottom against which the head seats. The fastener hole can define an unthreaded portion 21UT. The unthreaded portion 21UT can be disposed in the first part 25 of the handguard. A threaded portion 21T of the hole can extend in the second part 26, on the opposite side of the slit 27 from the unthreaded portion 21UT. The hole 21 and its portions can be transverse and/or perpendicular the slit 27. In the second part 26, the hole can include threaded portion 21T that can be a smaller diameter than the hole in the unthreaded portion 21UT in the first part 25. This smaller part of the fastener hole 21 can be referred to as a secondary hole 21S which can extend through to the opposite side of the handguard. The secondary hole 21S and threaded portion 21T can be configured to receive a similarly threaded tip 61T of the fastener 61. The tip can be received in that secondary hole optionally when the fastener 61 is pushed past the annular groove 41 into the threaded portion 21T, optionally spanning across both the first part 25 and the second part 26 of the handguard, and further optionally when the head 61H is in head recess 21B.

Figure 3:
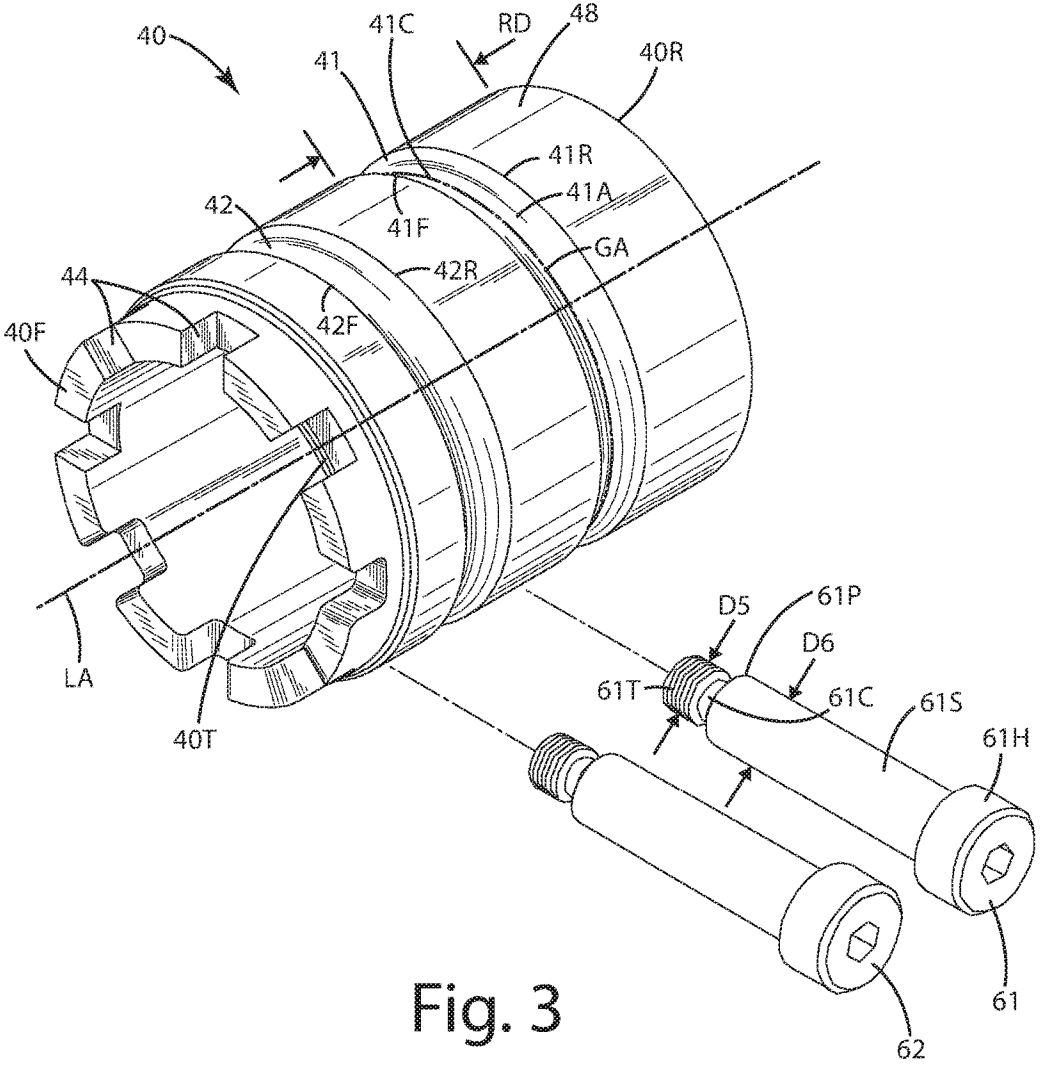
FIG. 3 is a perspective view of a barrel nut and fasteners of the hand guard securement system.
Figure 4:
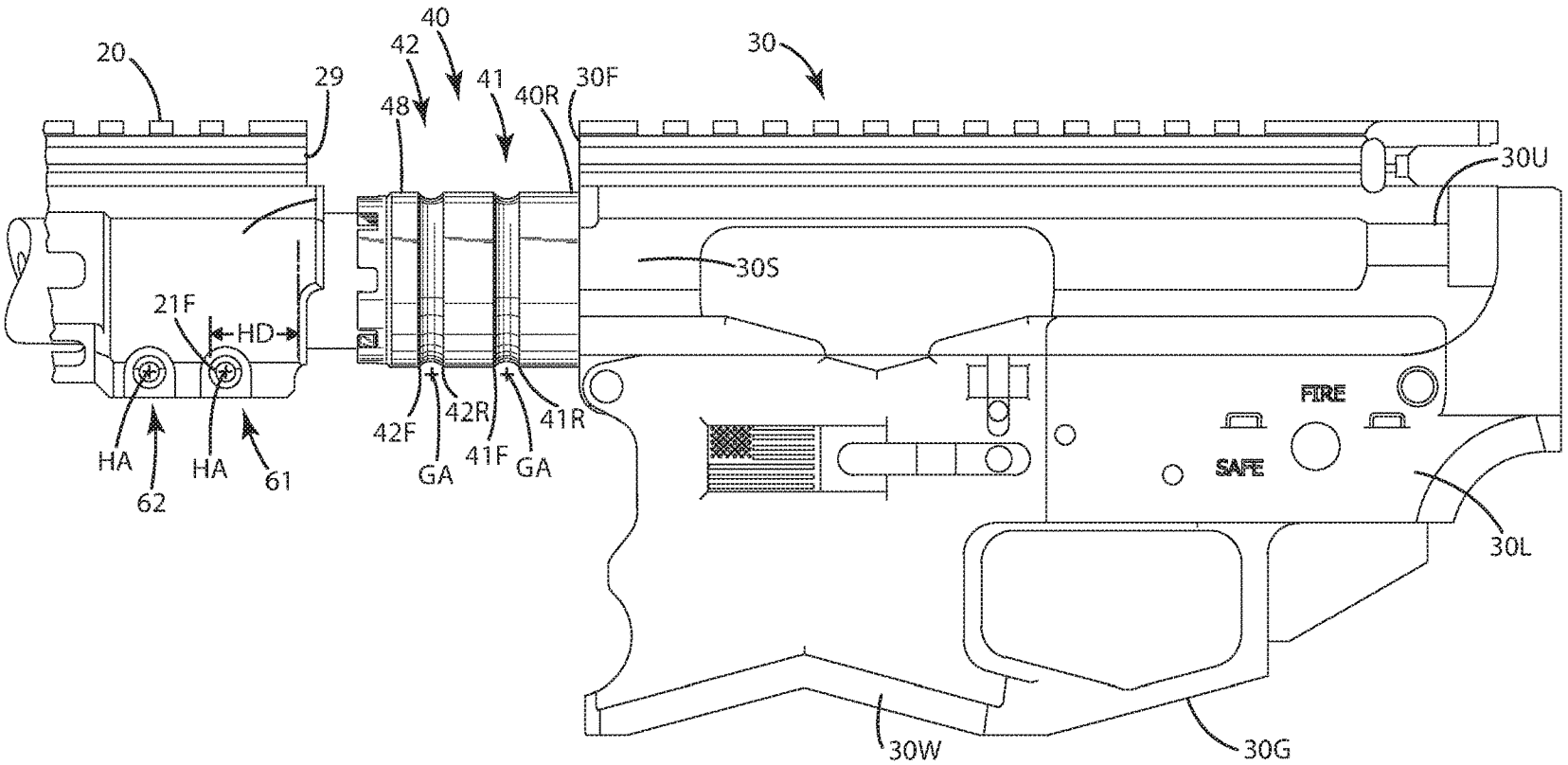
FIG. 4 is a side view of the handguard securement system with a barrel and barrel nut installed on a receiver, without the handguard being secured.

As mentioned above, the handguard securement system 10 can include one or more fasteners 61 and 62. These fasteners, as illustrated in FIGS. 3 and 6 can be optionally can be in the form of shoulder bolts. Optionally, the handguard can be constructed so that the front most portion 21F of the hole 20 in a hole distance HO distal from the rear edge 29 of the handguard. This hole distance HD can be greater than a ring distance RD between the front rim 41F of the groove 41 and the rear surface 40R of the barrel nut 40. Likewise, the distance between the rear edge 29 of the handguard and the hole axis HA of hole 21 can be greater than the distance between the rear surface 40R the barrel nut and the central axis of groove 41. As mentioned above, the fasteners can be identical so they can be interchangeably used in different fastener holes of the same handguard system. The fasteners can include a head 61H shaft or shank 61S that optionally is unthreaded along its entire length. The fastener 61 can include a shoulder portion 61P at which fastener 61 transitions to a tip portion 61T. Optionally this tip portion can be threaded and can include a diameter D5 that is less than the diameter D6 of the unthreaded shank 61S. A reduced diameter connector portion 61C can be included to join the tip and shank. Optionally the tip 61T diameter D5 is 1%, 2%, 3%, 4%, 5%, 6%, 7%, 8%, 10% or less than the diameter D6 of the threaded shaft 61S. This is so that the tip portion, as shown FIG. 6 can clear portion of the barrel nut that obstructs the hole 21, shown in FIGS. 5-6, when the handguard 20 is initially installed against the receiver 30 as described below.

Figure 10:
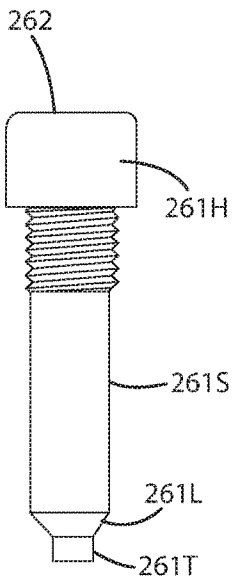
FIG. 10 is a side view of a second alternative fastener for use with the handguard securement system.
Figure 9:
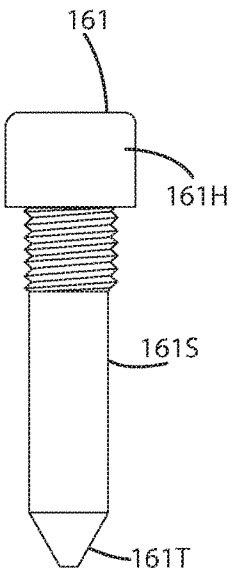
FIG. 9 is a side view of an first alternative fastener for use with the guard securement system.
Figure 8:
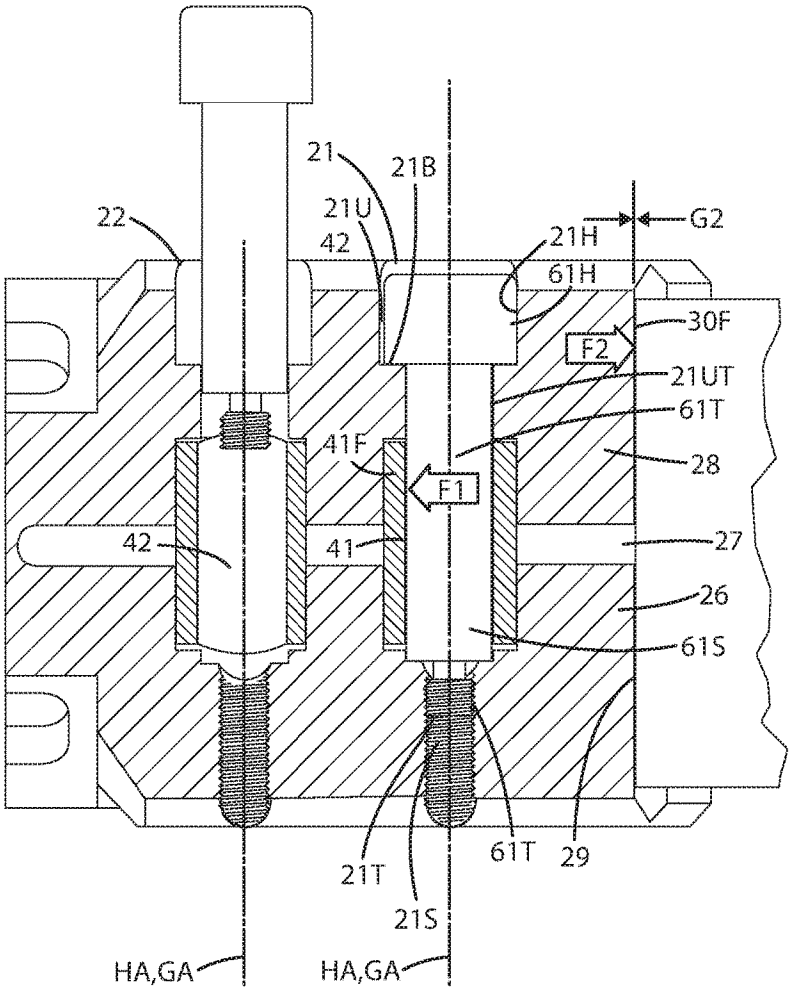
FIG. 8 is a cross section view of the handguard securement system taken along lines 8-8, illustrating fasteners installed to exert force against the handguard and thereby force the handguard against the receiver.

Optionally, the fasteners 61 and 62 can be constructed in forms other than a shoulder bolt. For example, in FIG. 9, a first alternative fastener 161 shown in FIG. 9 can include a head 161H that transitions to a shank 161S. The shank 161S can be partially or fully threaded as shown to thread into a threaded portion (not shown) of the first part 25 and/or second part of 26 of the handguard. The threaded shaft can transition to a conical tip portion 161T. The tip portion can be truly conical or it can be frustoconical or some other tapered configuration that assists the fastener 161 to pass by an obstructing portion of the barrel nut, allowing further securement and advancement of the fastener into the respective fastener hole. As another example, shown in FIG. 10, a second alternative fastener 261 can include a head 261H and a shank 261S. The shank can transition to the tip portion 261T. Part of the shank and tip can be threaded. The tip 261T can be of a smaller diameter than that of the shank 261S. At the transition between the shank and the tip, however, the fastener can include a tapered portion 261L. This tapered portion can include a partially frustoconical portion that decreases in diameter, from that of the diameter of the shaft 261S to the diameter of the cylindrical tip portion 261T. As will be appreciated, other forms of fasteners can be utilized depending on the application. Generally these other types of fasteners can include a shank of a first dimension, and a tip or forward portion that is of a smaller dimension than the dimension of the shank. This is so the tip can easily pass by a portion of the barrel nut obstructing the fastener hole and enable the shank to slide and move in the annular groove to generate forces to push the handguard 20 into the receiver 30.

With reference to FIG. 3, the barrel nut 40 can define a threaded internal bore 40T, which again is configured to threadably engage the threaded portion of the base 32 and secure the barrel nut and thus the barrel 50 to the receiver 30. The barrel 40 can include an exterior surface 48. The exterior surface 48 can be substantially cylindrical, however, other geometric shapes can be substituted therefor. For example, the exterior surface 48 can be of a an octagonal, hexagonal, elliptical or some other shape depending on the application and the configuration of the handguard 20. The barrel nut 40 can include a rear surface 40R and an opposing front surface 40F. The front surface 40F can define a plurality of contours 44. As shown, the contours 44 can be in form of recesses or slots in the forward end of the barrel nut. These contours 44 can be configured to engage a portion of a tool, which can be used to rotate the barrel nut 40 about the longitudinal axis LA and thereby tighten the barrel nut onto the base toward the receiver.

The barrel nut rear surface 40R can be in the form of an edge that is substantially planar and optionally lies within a plane that is orthogonal to the longitudinal axis LA. This planar surface 40 are can engage likewise planar forward surface 30F of the receiver to assist in aligning the barrel nut with the receiver properly. In some cases, the rear surface of the barrel nut can be serrated, knurled or have some other contour to assist in biting into and/or engaging the front surface or other surfaces of the receiver 30.

The barrel nut can define one or more annular grooves 41 and 42. These grooves can be similar or identical to one another except with regard to the placement. For example, the first annular groove 41 can be defined in the exterior surface 48 closer to the rear 40R of the barrel nut than the second groove 42. Given the similarity of the grooves, only the first groove 41 will be described here. The first groove 41 can be configured to extend all the way around the outer exterior surface, generally circumferentiating the barrel nut. In some cases, however, the annular groove can be interrupted by a series of regularly or irregularly placed portions of the exterior surface so that the annular groove is broken. As shown, the annular groove 41 is continuous around the longitudinal axis LA of the barrel nut 40.

The annular groove 41 can include a wall 41C. This wall 41C can be concave. The exterior surface 48 can transition to the wall 41C at a forward rim 41F and at a rearward rim 41R. This wall 41C can curve downward, toward a longitudinal axis LA of the barrel nut 40. The wall 41C can include an apex 41A at a location where the wall is closest to the longitudinal axis LA of the barrel nut. The annular groove can include a central axis GA, also referred to as a groove axis, located between the forward rim 41F and the rearward rim 41R. The groove axis can be located in a plane that bisects the groove 41 into equal sized forward parts and rearward parts relative to the longitudinal axis LA. Optionally, where the exterior surface 48 transitions to the forward rim or the rearward rim, these two surfaces can form a substantially right angle at that transition. As soon as the wall begins to transition downward, it becomes curved and no longer is at a right angle relative to the exterior surface.

Optionally, although the annular grooves are shown to include a concave wall, the grooves 41 and 42 can be of other geometric configurations. For example, when taking a cross-section of a groove, instead of it being semicircular or partially circular as with the current embodiment, the groove can be rectangular, triangular, square, polygonal, partially elliptical, rounded, or some other angled and/or rounded cross section. These annular grooves can be shaped so that when installed in the handguard holes, the fasteners project from the first part, through the groove, and into the second part of the handguard to allow the fasteners to be tightened and forcibly engage the handguard against the forward surface of the receiver.

A method of stalling the handguard on a firearm and/or other projectile shooting device using the handguard securement system of the current embodiments will be described. To begin, this method can be used to install the handguard on a firearm having an barrel and a receiver. Where the barrel nut is installed 20 relative to the receiver 30, a user can join these elements in the following manner. The barrel 50 can be placed adjacent the receiver 30. In particular, the barrel receiver end 52 can be positioned and inserted into the barrel bore 35 defined by the base 32. In so doing, the user can align the barrel indexing pin 54 with the pin recess 34. The user can slide the indexing pin into the pin recess to properly index the barrel relative to the receiver and its internal components.

The barrel nut can be moved over the barrel 50, generally in a direction away from the muzzle 50 toward the receiver end 52. The barrel nut can be placed such that the threaded internal bore 40T engages the threads 33 of the base 32. The barrel nut can be rotated to further thread the barrel nut onto the base toward the receiver.

The barrel nut can include rear surface 40R and a front surface 40F. The front surface 40F can be engaged by a tool to assist in the rotation about the longitudinal axis LA to thread the barrel nut onto the base. The threading continues until the barrel nut rear surface 40R engages the base 42 and is tightened to a particular torque, depending on the particular application and construction of the receiver.

With the barrel nut in place, the handguard 20 can be disposed over the barrel and over the barrel nut. For example, the handguard can be placed so that the rear end 23 travels over the muzzle 51 and the barrel 50 toward the receiver end 52. The handguard 40 also can be positioned such that the rear edge 29 is place closely to and optionally engages the front surface 30F of the receiver 30. The flanges 23F can overlap the side surfaces 30S of the receiver 30 to prevent and/or impair rotation of the handguard relative to receiver.

Upon this placement of the rear edge adjacent the front surface of the receiver, a gap G1 optionally is produced there between such that the rear surface does not tightly engage the front surface. In some cases, the gap G1 can be optionally 0.010 inches, further optionally 0.001 inches, yet further optimally 0.000 inches. The engagement force between these elements can be less than 0.25 pound such that the handguard can move or rotate relatively freely relative to the receiver. When such a gap is created, or generally when the front surface of the receiver is not adequately engaged against the rear surface of the handguard, the annular grooves 41 and 42 can be misaligned with the fastener holes as well. For example, as shown in FIGS. 5-6, with reference to the second fastener hole 22 and the second annular groove 42, the groove axis GA is offset from the hole axis HA such that the forward rim 42F of the annular groove 42 and the barrel nut in general obstructs a portion of the hole 22. In this condition, the hole axis and the groove axis GA are offset by distance D8. This distance D8 can be optionally 0.100, inches, further optionally 0.010 inches, further optionally 0.001 inches. In this configuration, the forward and rearward rim's 42F and 42R of the barrel nut are substantially misaligned with the outer boundaries of the fastener hole 22. Likewise, the rear rim 42R can be completely concealed within the hole 22 and not visible from a side view of the handguard as shown in FIG. 5. The first hole 21 and first groove 41 can likewise be offset by similar amounts. In this condition, the forward rim 42F obstructs at least a portion of the fastener hole 22 with the central axis of the groove being offset and disposed rearward of the hole axis HA by the distance D1. In some cases, D1 can be equal to D8 and/or G1.

Next, the fastener is inserted into the fastener hole, for example, fastener 61 is inserted in the fastener hole 21 as shown in FIG. 6. The tip 61T or reduced dimension of the remainder the shank can fit past the forward rim 41F obstructing the remaining portion of the hole 21. This tip 61T fits into the annular groove 41 of the barrel nut 40. Upon continued advancement of the fastener 61, unthreaded shank 61S slides relative to the annular groove and the forward rim. This further pushes the tip 61T through the annular groove or lease a portion thereof. As a result, the tip 61T eventually passes by the forward rim 41F of the annular groove. The portion of the shank 61S engaging the first part 25 slides and moves within the annular groove 41. The shank engages the annular groove and a portion of the first front rim 41F. This results in a force F1 being exerted by the shank against annular groove. The shank thus pushes against the annular groove. Because the shank is also engaging the unthreaded portion of the first part 25, it continues to exert a resulting force F2 to push the handguard 20 against the receiver 30. In this manner, the rear edge 29 of the handguard is pushed under force F2 against the front surface 30F of the receiver 30.

This force F2 continues until and after the tip portion 61T enters and threads into the secondary hole 21S of the fastener hole 21. When in place, the fastener 61 continues to exert force F1 against the annular groove 41, for example, the forward rim 41F. This, in turn continues to exert the force F2 of the handguard against the forward surface 30F of the receiver 30. This force F2 also causes the rear edge to be pushed against the front surface of the receiver and thereby reduce the first gap G1 to a smaller second G2. Again this gap G2 can be less than the gap G1 by varying percentages. In this manner, the handguard 20 can be pressed firmly against the receiver 30 for securement in a fixed position relative to that receiver. Optionally the second fastener 62 can be installed in the second fastener hole 22. In some cases, after installation of the first fastener 61 in first hole 21, the hole axis HA of the hole 22 can be aligned with the groove axis GA of the second groove 42 due to the interaction of the first fastener 61 and the first groove 41. In some cases, D8 can be equal to zero. Accordingly, installation of this fastener 62 can be easier than that of the first one 61. The second fastener, however, in some cases, can exert additional force to increase the overall force F2 to push the handguard against the receiver.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. A method of installing a hand guard on a firearm, the method comprising:

providing a barrel including a muzzle and a receiver end with a barrel extension adjacent the receiver end, the barrel extension including a barrel indexing pin;

providing a receiver including a front surface from which a cylindrical base extends, the cylindrical base including a threaded outer surface and defining a barrel bore;

inserting the receiver end into the barrel bore defined by the cylindrical base;

moving the barrel indexing pin into a pin recess defined by the cylindrical base;

moving a barrel nut over the barrel toward the receiver and away from the muzzle, the barrel nut defining a threaded internal bore, the barrel nut including a rear surface and a front surface, and an exterior surface extending therebetween, the exterior surface defining a first annular groove such that the exterior surface transitions to a concave wall at a forward rim and at a rear rim of the first annular groove, the concave wall curving toward a longitudinal axis of the barrel nut, the concave wall including an apex at a location where the concave wall is closest to the longitudinal axis of the barrel nut, the first annular groove including a first central axis between the forward rim and the rear rim;

threading the barrel nut on the threaded outer surface of the cylindrical base so as to secure the barrel to the receiver;

placing an elongated handguard over the barrel and over the barrel nut, the handguard including a rear edge and a front edge distal from the rear edge, the handguard including a rear end adjacent the rear edge, the rear end having a first part and a second part, the rear end defining a slot extending forward from the rear edge between the first part and the second part, the rear end defining a first fastener hole disposed transverse to the slot through the first part and the second part, the first fastener hole including a first hole axis, positioning the rear edge of the handguard adjacent the front surface of the receiver such that a first gap is produced therebetween, and such that the first annular groove is misaligned with the first fastener hole, with the forward rim obstructing at least a portion of the first fastener hole and such that the first central axis is offset from and rearward of the first hole axis;

inserting a first fastener in the first fastener hole, the first fastener including a first shank and a first head, the first shank terminating at a first tip that has a first diameter less than a second diameter of a remaining part of the first shank nearer to the first head than the first tip;

moving the first tip past the forward rim toward the slot; and engaging the first shank against the forward rim with a force such that the first shank pushes the rear edge against the front surface of the receiver, whereby the handguard is pressed against the receiver for securement in a fixed position relative to the receiver.

2. The method of claim 1, wherein during the engaging the first gap is eliminated so that the rear edge directly engages the front surface of the receiver with no gap therebetween.

3. The method of claim 2, wherein the force is at least 10 pounds, such that the handguard is non-rotatable relative to the receiver.

4. The method of claim 3, wherein the receiver includes a side surface adjacent the front surface, wherein the handguard includes a side flange that extends rearward from the hand guard beyond the rear edge, wherein the side flange is placed adjacent the side surface of the receiver during the positioning step.

5. The method of claim 4, wherein after the engaging step the first hole axis is generally aligned with the first central axis.

6. The method of claim 5, wherein the handguard defines a second fastener hole adjacent the first fastener hole, wherein the barrel nut defines a second annular groove adjacent the first annular groove, wherein the second fastener hole includes a second hole axis, wherein the second annular groove includes a second central axis.

7. The method of claim 6, comprising:

installing a second fastener in the second fastener hole after the second central axis is aligned with the second hole axis, wherein alignment of the second central axis with the second hole axis occurs after the first fastener is installed in the first hole.

8. A method of installing a hand guard on a firearm, the method comprising:

moving a barrel nut over a barrel toward a receiver including a front surface, the barrel nut including a rear surface and an exterior surface extending forward from the rear surface, the exterior surface defining a first annular groove such that the exterior surface transitions to a downward extending recess at a forward rim and at a rear rim of the first annular groove, the barrel nut including a longitudinal axis, the first annular groove including a first central axis between the forward rim and the rear rim;

joining the barrel nut with the receiver to secure the barrel to the receiver;

positioning a handguard over the barrel nut, the handguard including a rear end adjacent a rear edge, the rear end defining a slot extending forward from the rear edge between a first part and a second part, the rear end defining a first fastener hole disposed transverse to the slot through the first part and the second part, the first fastener hole including a first hole axis, positioning the rear edge of the handguard adjacent the front surface of the receiver, with the first annular groove being misaligned with the first fastener hole, with the forward rim obstructing at least a portion of the first fastener hole, and with the first central axis being offset from the first hole axis;

inserting a first fastener in the first fastener hole, the first fastener including a shank and a tip;

moving the tip past the forward rim toward the slot; and engaging the shank against the forward rim such that the rear edge forcibly engages the front surface of the receiver;

wherein the handguard is pressed against the receiver for securement in a fixed position relative to the receiver.

9. The method of claim 8 comprising:

tightening the first fastener such that the first part moves toward the second part of the handguard, wherein the handguard clamps the barrel nut within the handguard upon the tightening of the first fastener.

10. The method of claim 9, wherein the clamping continues as the first fastener is advanced in the first hole, wherein the clamping continues as the first fastener engages the first rim to drive the handguard rearward toward the receiver.

11. The method of claim 8, comprising:

moving the tip of the first fastener in the first fastener hole such that the tip clears the forward rim of the first annular groove but the shank engages the forward rim;

advancing the first fastener into the first hole such that a thread of the tip engages a corresponding thread of the first hole.

12. The method of claim 11, wherein the tip has a first dimension that is less than a second dimension of the shank, wherein the first fastener is a shoulder bolt.

13. The method of claim 8, comprising:

moving a second hole axis of a second hole defined by the handguard toward a second central axis of a second annular groove defined by the barrel nut during the engaging step.

14. The method of claim 13, comprising:

aligning the second hole axis with the second central axis so that a forward rim of the second annular groove no longer obstructs at least a portion of the second hole; and advancing a second fastener in the second hole along the second hole axis.

15. The method of claim 8 comprising:

moving the handguard over the barrel from a muzzle of the barrel toward a receiver end of the barrel; and placing a side flange of the handguard adjacent a side surface of the receiver to impair rotation of the handguard relative to the receiver.

16. The method of claim 8 comprising:

advancing a second fastener through a second hole defined by the handguard;

engaging the second fastener against a forward rim of a second annular groove defined by the barrel nut to provide a supplemental force and push the rear edge against the forward surface of the receiver.

17. The method of claim 8, advancing the first fastener into the first hole such that the fastener exerts a rearward force on the handguard as a shank of the fastener engages the forward rim of the first annular groove.

18. The method of claim 17, comprising:

clamping the barrel nut within the handguard by tightening the first fastener to draw the first part toward the second part, wherein the downward extending recess is of a semicircular cross section, wherein the forward rim is separated from the rearward rim by a distance that is greater than a diameter of the shaft of the first fastener.

19. A firearm handguard securement system comprising:

a barrel;

a receiver including a front surface;

a barrel nut disposed over the barrel, the barrel nut including a rear surface and an exterior surface extending forward from the rear surface, the exterior surface defining a first annular groove such that the exterior surface transitions to a downward extending recess at a forward rim and at a rear rim of the first annular groove, the barrel nut including a longitudinal axis, the first annular groove including a first central axis between the forward rim and the rear rim, the barrel nut securing the barrel to the receiver;

a handguard disposed over the barrel nut, the handguard including a rear end adjacent a rear edge, the rear end defining a slot extending forward from the rear edge between a first part and a second part, the rear end defining a first fastener hole disposed transverse to the slot through the first part and the second part, the first fastener hole including a first hole axis, the rear edge of the handguard being adjacent the front surface of the receiver with a first gap therebetween, such that the first annular groove is misaligned with the first fastener hole, with the forward rim obstructing at least a portion of the first fastener hole and such that the first central axis is offset from and rearward of the first hole axis;

a first fastener in the first fastener hole, the first fastener including a shank and a tip, the shank being engaged with the first annular groove so as to push the hand guard toward the front surface so that the rear edge forcibly engages the front surface of the receiver under a first force of at least 5 pounds, whereby in the handguard is pressed against the receiver for securement in a fixed position relative to the receiver.

20. The system of claim 19, wherein the barrel nut includes a cylindrical exterior surface, wherein the first annular groove is concave, wherein the first fastener is a shoulder bolt, wherein the shank is cylindrical and has a first diameter, wherein the tip is cylindrical and has a second diameter, wherein the second diameter is less than the first diameter, wherein the handguard includes an anti-rotation flange extending rearward beyond the rear edge, wherein the receiver includes a side surface, wherein the anti-rotation flange is placed immediately adjacent the side surface of the receiver.

* * * * *